US005806341A

United States Patent [19]

Rathbone

[11] Patent Number: 5,806,341

[45] Date of Patent: Sep. 15, 1998

[54] METHOD AND APPARATUS FOR AIR SEPARATION

[75] Inventor: Thomas Rathbone, Farnham, United Kingdom

[73] Assignee: The BOC Group plc, Windlesham, United Kingdom

[21] Appl. No.: 688,750

[22] Filed: Jul. 31, 1996

[30] Foreign Application Priority Data

Aug. 3, 1995 [GB] United Kingdom ..... 9515907

[51] Int. Cl.[6] ..... F25J 5/00

[52] U.S. Cl. ..... 62/646; 62/25; 62/24; 62/38; 62/39

[58] Field of Search ..... 62/646, 654, 913, 62/940, 643, 645, 650, 651, 652, 656

[56] References Cited

U.S. PATENT DOCUMENTS

| | | | |
|---|---|---|---|
| 4,152,130 | 5/1979 | Theobald | 62/646 |
| 4,867,773 | 9/1989 | Thorogood et al. | 62/652 |
| 5,152,149 | 10/1992 | Mostello et al. | 62/650 |
| 5,165,245 | 11/1992 | Agrawal et al. | 62/646 |
| 5,329,776 | 7/1994 | Grenier | 62/646 |
| 5,355,681 | 10/1994 | Xu | 62/25 |
| 5,428,962 | 7/1995 | Rieth | 62/646 |

FOREIGN PATENT DOCUMENTS

A-0 504 029 9/1992 France .

*Primary Examiner*—Henry A. Bennett
*Assistant Examiner*—Pamela A. O'Connor
*Attorney, Agent, or Firm*—David M. Rosenblum; Salvatore P. Pace

[57] ABSTRACT

Air is compressed in an arrangement of compressors. A first flow of the thus compressed air flows through a main heat exchanger from its warm end to its cold end and is liquefied by passage through a valve. Two second stream of compressed air are taken. One is expanded in one expansion turbine and the other in another expansion turbine. The streams leaving the valve and the one expansion turbine are separated in a double rectification column. Liquid oxygen product is extracted from outlet thereof. Part is taken as liquid product and the rest is vaporized by passage through the heat exchanger from its cold end to its warm end and taken as gaseous oxygen product. The ratio of liquid oxygen product to total oxygen product is capable of being varied. Accordingly a chosen but variable proportion of the two second air streams flows to the double rectification column and a chosen but variable proportion of the two second air streams is returned to the arrangement of compressors to an intermediate compressor.

19 Claims, 2 Drawing Sheets

METHOD AND APPARATUS FOR AIR SEPARATION

BACKGROUND OF THE INVENTION

This invention relates to a method and apparatus for separating air.

The separation of air by rectification is well known. In one such method and apparatus for separating air suitable for producing liquid products there are performed the steps of further compressing a compressed stream of air, cooling a first flow of the further compressed air by heat exchange with at least one product of the separation and at least partially liquefying the cooled first flow, expanding with the performance of external work at least one second flow of the further compressed air, rectifying at least part of the liquefied air and at least part of the expanded second flow of air and thereby forming an oxygen fraction and a nitrogen fraction, and taking oxygen and nitrogen products from the rectification. Liquefaction of a part of the incoming air enables a liquid oxygen or a liquid nitrogen product, or both, to be produced. If a gaseous oxygen product is additionally required it may be taken as vapour from the rectification or it may be taken as liquid and vaporised, typically by heat exchange with the incoming air.

The expansion of the second flow of air meets the refrigeration requirements of the method and apparatus. A major proportion of the refrigeration requirements arises from the need to take liquid as distinct from gaseous products. Typically, the products are each produced at a constant rate. Sometimes, it is desired to change the rate at which the products are produced beyond that which can be achieved by simple increase or decrease of the flow rate of air into the plant. Although, for example, various so-called "variable demand" processes for separating oxygen from air are known these are intended to meet a periodically fluctuating demand for oxygen rather than a long term change in demand.

It is an aim of the present invention to provide a method and apparatus which can provide a wide variation in the proportion of the air flow to be withdrawn as liquid products so as to meet a long term change in demand.

SUMMARY OF THE INVENTION

According to the present invention there is provided a method of separating air comprising performing a plurality of compression steps to compress and further compress a stream of air, cooling a first flow of the further compressed air by heat exchange with at least one product of separation and at least partially liquefying the cooled first flow of further compressed air, expanding with the performance of external work at least one second flow of the further compressed air, rectifying at least part of the liquefied air and at least part of the expanded second flow of air and thereby forming an oxygen fraction and a nitrogen fraction, taking a liquid oxygen and/or liquid nitrogen product from the rectification, causing part of the expanded second air flow to flow in heat exchange passages intermediate the rectification and a location downstream of one of the compression steps and upstream of another of the compression steps, adjusting the ratio of liquid oxygen and/or liquid nitrogen products to total oxygen product that is taken, and making a complementary adjustment to the proportion of the expanded second flow that is recycled preferably by causing there to be a reverse in the direction of flow through said heat exchange passages.

The invention also provides apparatus for separating air comprising a main compressor for forming a stream of compressed air, a plurality of booster-compressors for further compressing the stream of compressed air, a main heat exchanger for cooling a first flow of the further compressed air by heat exchange with at least one product of the separation, an expansion device for expanding the cooled first flow of further compressed air, whereby in use the first flow of the further compressed air passes out of the expansion device at least partially in liquid state, at least one expansion turbine for expanding a second flow of the further compressed air with the performance of external work, a rectification means including at least one column communicating with the outlet of said expansion device and the outlet of said expansion turbine for separating the air into an oxygen fraction and nitrogen fraction, means for taking a liquid oxygen and/or a liquid nitrogen product from the rectification means, passages through the main heat exchanger for part of the second flow intermediate an outlet of the main compressor and the rectification column or arrangement of rectification columns, means for adjusting the ratio of liquid oxygen and/or liquid nitrogen products to total oxygen product, and means for making a complementary adjustment to the proportion that is recycled of the expanded second flow of air preferably by causing there to be, in use, a reverse in the direction of flow through said passages.

The greater the proportion of the expanded second flow of air that is recycled, the greater the amount of refrigeration that can be produced and hence the greater the said ratio that can be achieved while still maintaining a mass and heat balance. Reversal of the direction of flow intermediate the further compression and the rectification makes possible a greater variation in the proportion of the air flow to be withdrawn as liquid products than would be possible in the same method and apparatus were there to be no such reversal of flow.

The method and apparatus according to the invention are particularly suited for use when the gaseous oxygen product is produced by withdrawing liquid oxygen from the rectification, pressurising the withdrawn liquid oxygen, and vaporising the pressurised liquid oxygen by heat exchange with the first flow of the further compressed air.

One part of the second flow of air is preferably formed by expanding one stream of the further compressed air in a first expansion turbine with the performance of external work. Another part is preferably performed by cooling another stream of the further compressed air by heat exchange with at least one product of the separation to an intermediate temperature, withdrawing the cooled air stream from the heat exchange and expanding the cooled air stream in a second expansion turbine with the performance of external work. It is normally convenient for the other stream of air to be withdrawn at said intermediate heat exchange temperature from said first flow of further compressed air.

In a preferred apparatus according to the invention the outlet of the first expansion turbine communicates with an intermediate region of said heat exchange passages in the main heat exchanger. Preferably, the heat exchange passages communicate at the cold end of the main heat exchanger with the rectification column or one of the rectification columns and at the warm end of the main heat exchanger with a conduit intermediate the main compressor and the booster-compressors. The advantage of this preferred form of apparatus according to the invention is that its effective operation is possible under different flow regimes in which the air recycle flow may be zero or may be a maximum. Thus, a stream of expanded air is preferably introduced from the first expansion turbine into the said heat exchange passages at an intermediate temperature. In one flow regime, wherein the air recycle rate is less than a maximum, the stream of expanded air that is introduced from the first expansion turbine into the said heat exchange passages at an intermediate temperature divides into one sub-stream that is cooled in the said heat exchange passages and goes to the rectification, and another sub-stream that is warmed in the said heat exchange passages and forms a recycle flow. In a second flow regime, wherein the recycle rate can be at a maximum, the stream of expanded air which is introduced from the first expansion turbine into the heat exchange passages at the intermediate temperature is combined with part of the flow of expanded air from the second expansion turbine and is warmed therewith in the heat exchange passages and forms a recycle flow therewith. The part of the flow of the expanded air from the second turbine may be taken via a rectification column. In a third flow regime, wherein there is no recycle of air, the stream of expanded air which is introduced from the first expansion turbine into the set of heat exchange passages at the intermediate temperature is combined with a sub-stream of said compressed stream of air from upstream of said further compression and is cooled therewith in the heat exchange passages and is introduced therewith into the rectification.

The method according to the present invention may operate in any two or all three of the said flow regimes. Since the direction of flow through at least part of the aforementioned heat exchange passages is reversed from one flow regime to another, these heat exchange passages can be described as reversing heat exchange passages. The main heat exchanger therefore comprises a set of cooling passages, a set of warming passages and a set of the reversing passages. Each reversing passage is preferably sandwiched (i.e. located) between a pair of warming passages. Such an arrangement of passages facilitates good heat transfer irrespective of the flow regime.

Preferably the air is rectified in a double rectification column comprising a higher pressure rectification column and a lower pressure rectification column. The first and second expansion turbines both preferably expand air to the operating pressure of the higher pressure rectification column. Typically, the outlet of the second expansion turbine communicates directly with the higher pressure rectification column while the outlet of the first expansion turbine communicates with an intermediate region of the said set of reversing heat exchange passages.

Preferably, the compressed stream of air has water vapour and carbon dioxide extracted from it upstream of the further compression. Accordingly, there is no need to pass recycling air through the purification unit.

A number of different arrangements of booster-compressors may be employed. In one preferred arrangement there is an upstream booster-compressor whose outlet communicates a pair of downstream booster-compressors in parallel with one another. This makes it possible for one of the downstream booster-compressors to be coupled to the first expansion turbine and the other of the downstream booster-compressors to be coupled to the second expansion turbine. As a result, the external work performed is part of the further compression of the compressed air stream. Typically, the downstream booster-compressors both communicate with a common conduit from which the first and second flows of compressed air are taken.

Adjustment of the rate of recycle within a chosen flow regime or by changing flow regime is typically effected by appropriate adjustment of one of the machines that forms part of the apparatus according to the invention. For example, the main air compressor and/or the upstream booster-compressor may have adjustable inlet guide vanes whose positions may be changed to vary the recycle rate. In such an example, the inlet guide vanes of the main air compressor and those of the upstream booster compressor may be used to set the flow through each machine. If the flow rate through the upstream booster compressor is less than that through the main air compressor, there is no recycle, while if the flow rate through the upstream booster compressor is greater than that through the main compressor there is a recycle. There are a number of ways in which the ratio of the rate of production of a liquid oxygen and/or a liquid nitrogen product to that of total oxygen production may be changed. For example, the rate at which gaseous oxygen is produced may be changed by changing the rate at which liquid oxygen is vaporised in heat exchange with the first flow of further compressed air.

BRIEF DESCRIPTION OF THE DRAWINGS

The method and apparatus according to the invention will now be described by way of example with reference to the accompanying drawings, in which.

The drawings are not to scale.

DETAILED DESCRIPTION

Figure 1:
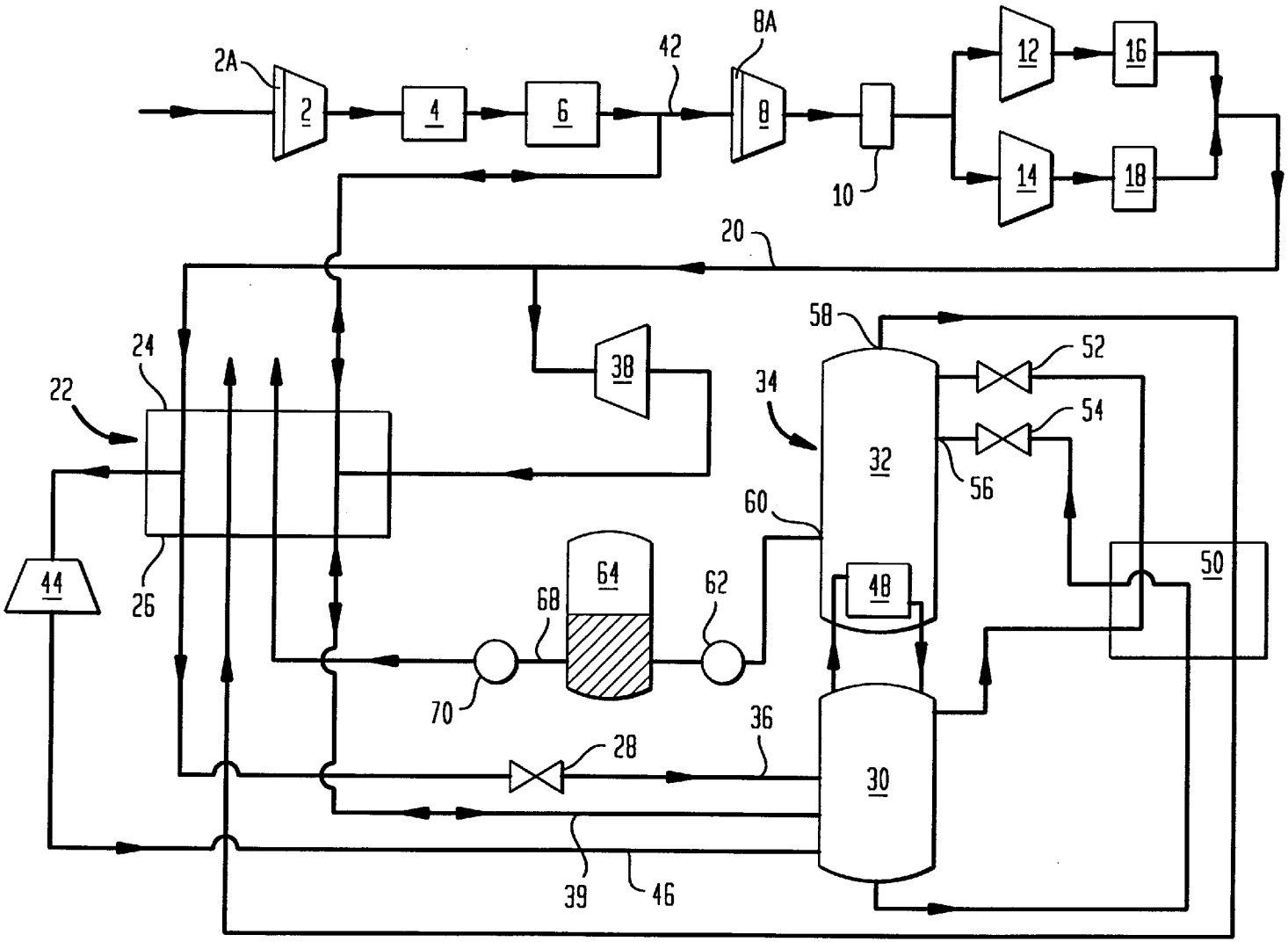
FIG. 1 is a schematic flow diagram of an air separation plant.

Referring to FIG. 1 of the drawings, a stream of air is compressed in a main air compressor 2 to a pressure typically in the range of 5 to 6 bar. The compressed air is cooled by direct evaporative contact with water in a cooler 4. The resulting cooled air is supplied to a purification unit 6 which is effective to remove water vapour, carbon dioxide and other impurities of relatively low volatility from the air. Typically, the air is purified in the unit 6 by adsorption. The construction and operation of adsorptive air purifiers are well known in the art and need not be described further herein. The purified air passes from the unit 6 into an upstream booster-compressor 8 which further compresses the pressure of the purified, compressed air stream to a pressure well in excess of that at which it is rectified. In one example of the operation of the plant shown in FIG. 1, the booster-compressor 8 raises the pressure of the purified, compressed air stream to a pressure in the order of 27 bar. The boosted air stream flows from the booster-compressor 8 and has the heat of compression generated in the booster-compressor 8 removed therefrom by passage through a heat exchanger 10, which may, for example, be cooled by water. The thus cooled air flow bifurcates. One flow passes to a first downstream booster-compressor 12 and is raised in pressure therein to a yet higher pressure. In the previously mentioned example of the operation of plant shown in FIG. 1, this pressure is typically in the order of 49 bar. The other stream of air from the heat exchanger 10 flows into a second downstream booster-compressor 14 connected in parallel with the first booster-compressor 12. The flow of air entering the booster-compressor 14 is typically compressed to the same pressure as that entering the booster-compressor 12. The air leaving the booster-compressors 12 and 14 is respectively cooled in heat exchangers 16 and 18 so as to remove heat of compression. The flow of air from the heat exchangers 16 and 18 is merged in a common conduit 20 to form a single stream of further compressed air, typically at 49 bar.

A first flow of further compressed air is taken at approximately ambient temperature from the common conduit 20 and flows through a main heat exchanger 22 from its warm end 24 to its cold end 26, being cooled as it passes therethrough by indirect heat exchange with returning product streams. The cooled first flow of further compressed air leaves the cold end 26 at the main heat exchanger 22 in liquid state or at a temperature such that it is converted to liquid on being expanded. The cooled first flow of further compressed air passes through an expansion device 28 and is reduced in pressure to the operating pressure of a higher pressure rectification column 30 which with a lower pressure rectification column 32 forms part of a double rectification column 34. A shown in FIG. 1, the expansion device 28 may be a Joule-Thomson valve. Alternatively, it may be an expansion turbine. The expanded first flow of further compressed air enters the higher pressure rectification column 30 almost entirely in liquid state through a first inlet 36.

One part of second flow of further compressed air is taken at approximately ambient temperature from the common conduit 20 and is expanded with the performance of external work in a first expansion turbine 38 to a temperature in the order of 180K and a pressure a few millibars above the operating pressure at the bottom of the higher pressure rectification column 30. Although not shown in FIG. 1, the rotor of the first expansion turbine 38 is preferably mounted on the same drive shaft as the rotor of the booster-compressor 12. By this means, the air expanding in the first expansion turbine 38 may be used to drive at the booster-compressor 12. The expanded air flows from the turbine 38 into an intermediate temperature region thereof. The air so introduced can flow through one set of heat exchange passages (not shown in FIG. 1) of the main heat exchanger 22 in one or both of two different directions. In one of these directions the air flows out of the cold end 26 of the main heat exchanger 22 and flows into the higher pressure rectification column 30 through a second inlet 39. In the other of the directions the air flows out of the warm end 24 of the main heat exchanger 22 and mixes in a conduit 42 with the purified compressed air stream intermediate the unit 6 and the upstream booster-compressor 8.

In addition to the air that is expanded in the second expansion turbine 44, a second part of the second flow of air is withdrawn from the first flow of the further compressed air at a temperature of about 150K the second part being withdrawn from an intermediate region of the main heat exchanger 22. The second part is expanded with the performance of external work in a second expansion turbine 44. Although not shown in FIG. 1, the rotor of the second expansion turbine 44 is mounted on the same shaft as the rotor of the downstream booster-compressor 14. The work performed by the expansion of the air in the second expansion turbine 44 is thus the compression of the air in the booster-compressor 14. The expanded air leaves the expansion turbine 44 at essentially the operating pressure at the bottom of the higher pressure rectification column 30 and at its saturation temperature. The expanded air flows from the second expansion turbine 44 into the higher pressure rectification column 30 through a third inlet 46 which is, like the inlet 39, located below all liquid-vapour contact devices (not shown) in the column 30.

Air introduced into the higher pressure rectification column 30 is separated by rectification therein into an oxygen-enriched liquid and a nitrogen vapour. The nitrogen vapour is condensed in a condenser-reboiler 48 located in the bottom of the lower pressure rectification column 32. The condensation of the nitrogen vapour is effected by indirect heat exchange with boiling liquid oxygen. A part of the resulting condensate is used as liquid nitrogen reflux in the lower pressure rectification column 30. Another part is sub-cooled by passage through part of a further heat exchanger 50, is expanded by passage through a Joule-Thomson valve 52 and is introduced as liquid nitrogen reflux into the top of the lower pressure rectification column 32. A stream of the oxygen-enriched liquid is withdrawn from the bottom of the higher pressure rectification column 30, is sub-cooled by passage through a part of the further heat exchanger 50, is expanded by passage through a Joule-Thomson valve 54 and is introduced through an inlet 56 into an intermediate mass exchange region of the lower pressure rectification column 32.

The oxygen-enriched liquid is separated in the lower pressure rectification column 32 into an oxygen fraction at the bottom of column 32 and a nitrogen fraction at the top of the column 32. The separation takes place as a result of mass exchange between ascending vapour (formed in the reboiling passages of condenser-reboiler 48) and descending liquid. The mass exchange takes place on liquid-vapour contact devices (not shown) such as structured packing or distillation trays provided in the column 32. Typically, but not necessarily, both the oxygen fraction and the nitrogen fraction that are separated in the lower pressure rectification column 32 may each contain less than 0.1% by volume of impurity. A nitrogen stream in vapour state is withdrawn from the top of the lower pressure rectification column 32 through an outlet 58 and passes through the further heat exchanger 50, thereby providing the necessary refrigeration for the sub-cooling of the oxygen-rich liquid and liquid nitrogen streams. Downstream of the further heat exchanger 50, the nitrogen vapour stream flows through the main heat exchanger 22 from its cold end 26 to its warm end 24. The nitrogen typically leaves the warm end 24 of the main heat exchanger 22 at approximately ambient temperature and pressure.

A liquid oxygen stream, which forms the entire oxygen production of the plant, is withdrawn from the bottom of the lower pressure rectification column 32 through an outlet 60 by means of a pump 62. The liquid oxygen is passed to a storage tank 64 which has a product outlet 68 communicating with a second liquid oxygen pump 70 which pressurises the liquid oxygen to an elevated pressure and passes the pressurised liquid through the main heat exchanger 22 from its cold end 26 to its warm end 24. The pressurised liquid oxygen is thus vaporised and warmed to approximately ambient temperature by indirect heat exchange with first flow of further compressed air. Liquid oxygen may from time-to-time be withdrawn to a tanker (not shown) from the storage tank 64 through an outlet (not shown). The outlet pressures of the downstream booster-compressors 12 and 14 are selected so as to maintain a close match between the temperature-enthalpy profile of the streams being cooled and that of the streams being warmed in the main heat exchanger 22. Typically, in the example in which the booster-compressors 12 and 14 both have an outlet pressure of 49 bar, the pump 70 raises the pressure of the liquid oxygen to 36 bar. Depending on the pressure at which the gaseous oxygen product is required, the pump 70 may raise the liquid oxygen flowing therethrough to a supercritical pressure. It is to be understood that the term "gaseous oxygen product" used herein includes within its scope a stream of liquid oxygen that has been pressurised to above its critical pressure and has been warmed to above cryogenic temperatures.

The plant shown in FIG. 1 can operate in a number of different flow regimes. In a first flow regime the expanded air introduced from the first expansion turbine 38 into an intermediate temperature region of the main heat exchanger 22 bifurcates. One part of the flow goes to the higher pressure rectification column 30 through the inlet 39. The remainder of the flow flows in the opposite direction to the warm end of the main heat exchanger 22 and is recycled to the conduit 42. This part of the air is thus compressed again in the booster-compressors 8, 12 and 14. The recycle enhances the flow of air through the expansion turbines 38 and 44 thus enhances the production of refrigeration therein. The greater the amount of refrigeration produced, the greater is the proportion of the oxygen product that can be produced as liquid. (In the plant shown in FIG. 1, the rate of production of liquid oxygen is the difference between rate of flow of oxygen through the pump 62 and that through the pump 70, and the rate of production of gaseous oxygen is the flow through the pump 70.) It is to be appreciated that in the plant shown in FIG. 1, there is no production of liquid nitrogen, though, if desired, a liquid nitrogen product could be produced.

In the first flow regime in which gas entering the main heat exchanger 22 from the first expansion turbine 38 flows in both directions, all the air expanded in the second expansion turbine 44 is separated in the double rectification column 34 without any of it being recycled. In a second flow regime, the upstream booster-compressor 8 is adjusted such that not only is all the air from the first expansion turbine 38 recycled to the booster-compressor 10, but also air from the second expansion turbine 44 is drawn out of the higher pressure rectification column 30 through the inlet 39 and flows from the cold end 26 of the main heat exchanger 22 to the intermediate region at which the air from the first expansion turbine 38 is introduced and mixes with this air. As a result, the rate of recycle of air is greater than in the first flow regime. Therefore more refrigeration is generated in the expansion turbines 38 and 44 and as a result the ratio of the rate of production of liquid oxygen to that of gaseous oxygen is substantially greater than in the first flow regime. In a third flow regime, all the air from the first expansion turbine 38 flows into the higher pressure rectification column 30 and there is no recycle of air.

The inlet guide vanes 2A of the main air compressor 2 and those 8A of the upstream booster-compressor 8 are set to determine the flow through each machine and the particular flow regime. In the first flow regime, in which a part of the air from the first expansion turbine 38 is recycled, the flow through the upstream booster-compressor 8 is greater than that through the main air compressor 2 there is a maximum pressure in the main heat exchanger 22 at the region at which the expanded air flow from the first expansion turbine 38 is introduced. This maximum pressure is higher than that at the inlet to the upstream booster-compressor 8 and the pressure at the inlet 39 to the higher pressure rectification column 30. The main air compressor 2 is operated such that the pressure downstream of the purification unit 6 is matched to that at the warm end 24 of the main heat exchanger 22, as the recycled air and the air from the compressor 2 together form the suction flow to the booster-compressor 8.

In the second flow regime, the pressure in the reversing passages at the cold end 26 of the main heat exchanger 22 is greater than that in the reversing passages at the region where the expanded air from the first expansion turbine 38 is introduced, and also greater than that in the reversing passages at the warm end 24 of the main heat exchanger. Again, the discharge pressure of the main air compressor is at the appropriate level to match the pressure of the stream being recycled to the booster-compressor 8.

In the third flow regime, in which there is no recycle, the pressure in the reversing passages in the main heat exchanger 22 at its warm end 24 is higher than that at the inlet 39 to the higher pressure rectification column 30.

The actual pressures and their relative magnitudes in each flow regime are of course the result of the size and direction of the flow, and can be set by appropriate adjustment of the inlet guide vanes 2A and 8A of both the main compressor 2 and the booster-compressor 8.

Typically, in one mode of operation of the plant shown in FIG. 1, the rate of flow of pressurised oxygen from the pump 70 through the main heat exchanger 22 is kept constant and the ratio of the rate of production of liquid oxygen at the rate of production of gaseous oxygen is varied merely by varying the rate at which the liquid oxygen level in the storage tank 64 rises. In the third flow regime up to 50% of the total oxygen product may be taken as liquid (either oxygen or nitrogen, or both); in the first flow regime up to 80% of the total oxygen product may be taken as liquid. Even higher liquid productions can be achieved in the second flow regime.

Figure 2:
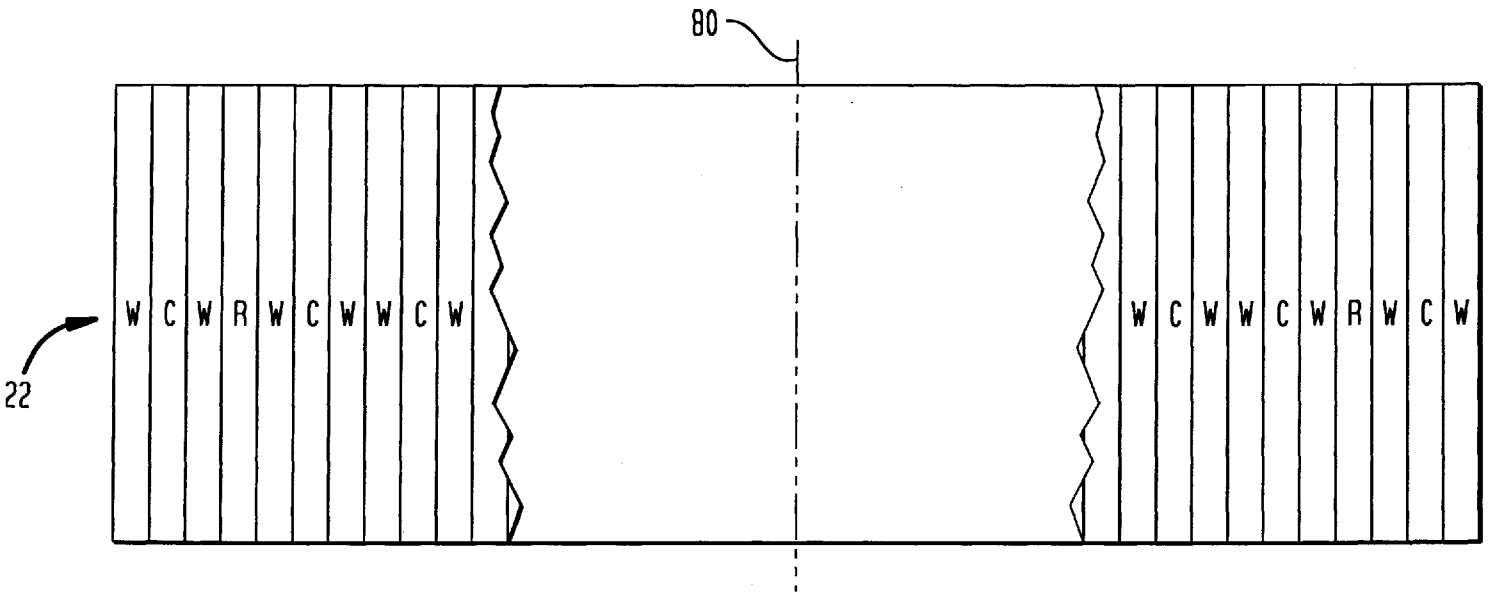
FIG. 2 is a schematic cross-section through the main heat exchanger of the plant shown in FIG. 1, the cross-section being taken transversely to the directions of flow through the main heat exchanger.

The arrangement of the different sets of heat exchange passages in the main heat exchanger 22 is illustrated in FIG. 2. There are three sets of passages. A first set of cooling passages C is for the first flow of further compressed air from the conduit 20 and effect the cooling of this flow of air. A second set of warming passages W is allocated between the nitrogen vapour stream and the pressurised oxygen stream. A third set of reversing passages R are for the flow of expanded air from the first expansion turbine 38. Each reversing passage R is sandwiched between a pair of warming passages W. The arrangement of passages shown in FIG. 2 is typical. The passages to the right of a centre line 80 are a mirror image of the passages to its left. From the extreme left hand edge, the pattern WCWRWCWWCW is repeated until the centre line 80 is reached. Typically, in the order of from 10 to 12% of the passages are reversing passages. This allocation of passages makes possible effective heat transfer between the streams being cooled and those being warmed irrespective of whether the flow through the reversing passages R is bifurcated, is from the warm end 24 to the cold end 26, or is from the cold end 26 to the warm end 24 of the main heat exchanger 22. The extreme right hand passage and the extreme left hand passage are both warming passages so as to prevent "edge effects" from being too great.

A large number of changes and modifications may be made to the plant shown in FIG. 1 of the drawings. If desired, a single downstream booster-compressor may be substituted for the booster-compressors 12 and 14. If desired, the rotor of such a single downstream booster-compressor may be mounted on the same shaft as the rotors of the respective first and second expansion turbines 38 and 44. In another alternative, one of the downstream booster-compressors 12 and 14 may be dedicated to supplying the first expansion turbine 38 and the other to supplying the first flow of further compressed air and the flow to the second expansion turbine that is branched off from the first flow. In a further alternative, all of the booster-compressors may be motor driven, and the expansion turbine used to drive electrical generators.

If desired, argon may be produced by withdrawing an argon-enriched oxygen stream from the lower pressure rectification column 32 and separating it in the further rectification column. Condensation for the further rectification column may be provided by at least part of the flow of the oxygen-enriched air en route to the lower pressure rectification column 32. It is also possible to use more complex arrangements of rectification columns, for example, of the kind disclosed in our copending application No (GB) 9505645.

Other modifications that may have been made include the withdrawal of a liquid nitrogen product, or the formation of an elevated pressure gaseous nitrogen product by pressurising a stream of liquid nitrogen and vaporising it by heat exchange with incoming air. A yet further modification is the production of two elevated pressure gaseous oxygen products of different pressures from one another. For example, in addition to the 36 bar oxygen product, an oxygen product at approximately 11 bar may be produced. In that instance, a stream of air may be taken from immediately downstream of the heat exchanger 10 and cooled and condensed by heat exchange with the lower pressure oxygen product, the resulting liquid air being introduced into the higher pressure rectification column 30 through another expansion device.

I claim:

1. A method of separating air comprising:

performing a plurality of compression steps to compress and further compress a stream of air;

cooling a first flow of the further compressed air by heat exchange with at least one product of the separation and at least partially liquefying the cooled first flow of the further compressed air;

expanding with the performance of external work at least one second flow of the further compressed air;

rectifying at least part of the liquefied air and at least part of the expanded second flow of air and thereby forming an oxygen fraction and a nitrogen fraction;

taking a liquid oxygen and/or a liquid nitrogen product from the rectification;

causing part of the expanded second air flow to flow in heat exchange passages intermediate the rectification and a location downstream of one of the compression steps and upstream of another of the compression steps;

adjusting the ratio of at least one liquid product to total oxygen product that is taken; and adjusting flow direction of a proportion of expanded second flow of air between said location of downstream of said one of the compression steps and upstream of another of the compression steps and said heat exchange passages to inturn adjust recyle of said proportion of expanded second flow of air back to said location and therefore refrigeration and production of said liquid product.

2. The method as claimed in claim 1, in which the said second flow of air comprises two parts, a first of said two parts comprising one stream of the further compressed air which is expanded in a first expansion turbine with the performance of external work, and a second of said two parts is formed by cooling another stream of the further compressed air, by heat exchange with at least one product of the separation, to an intermediate temperature, and withdrawing the cooled air stream from the heat exchange, the cooled air stream being expanded in a second expansion turbine with the performance of external work.

3. The method as claimed in claim 2, in which the another stream of air, forming said second of said two parts of said second flow of air, is withdrawn at the intermediate heat exchange temperature from said first flow of further compressed air.

4. The method as claimed in claim 2, in which a stream of expanded air is introduced from the first expansion turbine into the said heat exchange passages at an intermediate temperature, said flow direction of said proportion of said second flow of expanded air is adjusted so that in one flow regime, said stream of expanded air divides into one sub-stream that is cooled in the said heat exchange passages and goes to the rectification, and another sub-stream that is warmed in the said heat exchange passages and is recycled to said location downstream of said one of the compression steps and upstream of said another of the compression steps, thereby to form said proportion of said second flow of expanded air, and in a second flow regime, the stream of expanded air which is introduced from the first expansion turbine into said heat exchange passages at the intermediate temperature, is combined with a part of the flow of expanded air from the second expansion turbine is warmed therewith in the heat exchange passages, and is recycled therewith to said location, thereby to form said proportion of said second flow of expanded air.

5. The method as claimed in claim 4, in which the part of the flow of expanded air from the second expansion turbine that is recycled flows via the rectification.

6. The method as claimed in claim 4, in which said flow direction is further adjusted so that in a third flow regime the stream of expanded air which is introduced from the first expansion turbine into the said heat exchange passages at the intermediate temperature is combined with a sub-stream of compressed air formed from said stream of air and taken prior to further compression of said stream of air, is cooled therewith in the heat exchange passages, and is introduced therewith into the rectification, whereby no air is recycled in the third flow regime.

7. The method as claimed in claim 2, in which the stream of air that is expanded in the first expansion turbine is introduced into the first expansion turbine at a temperature not less than that at which said first flow of air is brought into heat exchange with said product of the separation.

8. The method as claimed in claim 2, wherein the air is rectified in a double rectification column comprising a higher pressure rectification column and a lower pressure rectification column, and the first and second expansion turbines both expand air to the operating pressure of the higher pressure rectification column.

9. The method as claimed in claim 1, in which the stream of air has water vapour and carbon dioxide extracted therefrom upstream of further compression of said stream of air.

10. The method as claimed in claim 1, wherein the said external work is performed in further compressing the compressed air stream.

11. The method as claimed in claim 1, in which the gaseous oxygen product is formed by pressurising a stream of liquid oxygen and vaporising it in heat exchange with the first flow of air.

12. An apparatus for separating air comprising:

a main compressor for forming a stream of compressed air;

a plurality of booster-compressors for further compressing the stream of compressed air;

a main heat exchanger for cooling a first flow of the further compressed air by heat exchange with at least one product of separation of the air;

an expansion device for expanding the cooled first flow of the further compressed air so that the first flow of the further compressed air passes out of the expansion device at least partially in liquid state;

at least one expansion turbine for expanding at least one second flow of the further compressed air;

rectification means including a rectification column communicating with the outlet of said expansion device and the outlet of said expansion turbine for separating the air into an oxygen fraction and a nitrogen fraction;

means for taking at least one liquid product from the rectification means;

the main heat exchanger having passages for part of the second flow of air intermediate an outlet of the main compressor and the rectification means;

means for adjusting the ratio of at least one liquid product to total oxygen product; and means for adjusting flow direction of a proportion of the expanded second flow of air by a reverse in the direction of flow through said passages to inturn adjust recyle of said proportion of expanded second flow of air back to said location and therefore refrigeration and production of said liquid product.

13. The apparatus as claimed in claim 12, wherein said at least one expansion turbine comprises a first expansion turbine having an inlet communicating with the outlet of at least one of the booster-compressors, and a second expansion turbine having an inlet communicating with an intermediate region of a flow path for further compressed air through the main heat exchanger.

14. The apparatus as claimed in claim 13, wherein the inlet to the second expansion turbine communicates with a flow path for the said first flow of further compressed air.

15. The apparatus as claimed in claim 13, in which the outlet of said first expansion turbine communicates with an intermediate region of a set of reversing flow passages through the main heat exchanger, the set of reversing flow passages communicating at the cold end of the main heat exchanger with the rectification column or one of the rectification columns, and at the warm end of the main heat exchanger with a conduit intermediate the main compressor and a booster-compressor, the arrangement being such that, in use, in one flow regime, the flow of expanded air from the first turbine divides into one sub-stream that is cooled in the said reversing heat exchange passages and goes to the rectification column or said one of the rectification columns and another substream that is warmed in the said reversing heat exchange passages and forms the recycle flow in a second flow regime, the stream of expanded air which is introduced from the first expansion turbine into the set of reversing heat exchange passages at the intermediate temperature is combined with a part of the flow of expanded air from the second expansion turbine and is warmed therewith in the reversing heat exchange passages and forms the recycle flow therewith, and in a third flow regime, the stream of expanded air which is introduced from the first expansion turbine into the set of reversing heat exchange passages at the intermediate temperature is combined with a sub-stream of compressed air formed from said stream of air and taken prior to further compression of said stream of air and is cooled therewith in the heat exchange passages and is introduced therewith into the rectification column of said one of the rectification columns, whereby no air is recycled in the third flow regime.

16. The apparatus as claimed in claim 13, in which the arrangement of rectification columns comprises a double column comprising a higher pressure rectification column and a lower pressure rectification column, and the outlet of the second expansion turbine and the set of reversing heat exchange passages at the cold end of the main heat exchanger both communicate with the higher pressure rectification column.

17. The apparatus as claimed in claim 13, in which the booster-compressors comprise an upstream booster-compressor whose outlet communicates with the inlet of each of a pair of downstream booster-compressors in parallel with one another.

18. The apparatus as claimed in claim 17, in which the main air compressor and the upstream booster-compressor have variable inlet vanes for adjusting the flow of air therethrough.

19. The apparatus as claimed in claim 12, additionally including a pump for pressurising a stream of liquid oxygen and passing it through the main heat exchanger so as to form a gaseous oxygen product.

* * * * *